United States Patent [19]

Davis

[11] 4,399,728

[45] Aug. 23, 1983

[54] SAW WORKPIECE PUSHING DEVICE

[76] Inventor: Leo L. Davis, 1207 Woodland Cir., Bolivar, Mo. 65613

[21] Appl. No.: 246,851

[22] Filed: Mar. 23, 1981

[51] Int. Cl.[3] ..... B27B 5/22

[52] U.S. Cl. ..... 83/418; 83/425; 83/437; 83/438; 83/477.2

[58] Field of Search ..... 83/425, 431.5, 437, 83/477.2, 467, 468, 438, 446, 418

[56] References Cited

U.S. PATENT DOCUMENTS

| | | | |
|---|---|---|---|
| 950,672 | 3/1910 | Lofton | 83/435.1 |
| 1,346,269 | 7/1920 | Smith | 83/435.1 |
| 2,754,859 | 7/1956 | Ocenasek | 83/438 |
| 3,246,675 | 4/1966 | Sweetser | 83/438 X |
| 4,002,329 | 1/1977 | Petrowski | 83/467 R |
| 4,026,173 | 5/1977 | Livick | 83/477.2 |

*Primary Examiner*—James M. Meister

*Attorney, Agent, or Firm*—Harvey B. Jacobson

[57] ABSTRACT

A saw workpiece pushing device is operably attachable to a table saw and is utilized to facilitate the cutting of styrofoam or other similar material. The device includes an elongated pushing member which is attachable to the saw's miter gauge and which includes an U-shaped frame defining an opening through which the saw blade may pass without interference with the pushing member. Additionally, a side guide member is attachable to the saw's fence so as to permit an outward expansion of the styrofoam once the same has been cut. The side guide member is fixedly securable to the fence through the use of a C-clamp positionable between the fence and a slot cut in the guide member, while the pushing member may be fixedly secured by conventional means to the miter gauge. A safety extension is provided on one side of the U-shaped frame which operates to push the cut styrofoam off the table without the necessity of an operator using his hand near the saw blade to remove the styrofoam.

4 Claims, 5 Drawing Figures

SAW WORKPIECE PUSHING DEVICE

BACKGROUND OF THE INVENTION

1. Field of the Invention

The present invention relates generally to workpiece guides used with power saws and more particularly pertains to a specially designed guide for facilitating the cutting of styrofoam or similar materials on a table saw.

2. Description of the Prior Art

With respect to the use of powered table saws, it can be appreciated that there has been a large number of different types of guides developed which facilitate the cutting of workpieces by the saws. In this respect, table saws typically come equipped with general purpose guides which assist an operator in performing the desired cuts. Specifically, table saws are conventionally provided with a moveably securable guide rail or fence normally parallel to the cutting plane of the saw blade, such fence permitting a workpiece to be slid therealong into cutting contact with the blade. By the same token, conventional table saws are usually further equipped with a movable miter gauge which is slidable within a slot also paralleledly aligned with the cutting plane of the blade and which is utilizable to effectively push a workpiece into contact with the blade. In this connection, the miter gauge is selectively rotatable about a pivot axis whereby the dual function of pushing the workpiece and guiding the same is accomplished.

While the conventional fence and miter gauge arrangement of a table saw is all that is normally required to effectively cut a workpiece, in certain instances specially designed guides must be provided due to the peculiar shape or type of material being cut. For example, it is well recognized in the art that the cutting of styrofoam presents special problems, particularly when the styrofoam is cut on a table saw, since the expansible characteristics of styrofoam results in the same frequently binding and kicking back during a cutting operation. Additionally, the flexible structure of the styrofoam creates special safety problems during a cutting operation since an operator must normally utilize his hands in close proximity to the cutting blade in order to stabilize the styrofoam during a cutting operation.

Accordingly, it can be appreciated that there exists a need for a specially designed guide utilizable in connection with a table saw which would permit the safe and reliable cutting of styrofoam or other similar expansible and flexible materials. In this respect, the present invention substantially fulfills this need.

SUMMARY OF THE INVENTION

The present invention, which will be described subsequently in greater detail, provides a saw workpiece pushing device that is particularly effective in the cutting of styrofoam or other similar material and which possesses all of the advantages of the prior art workpiece pushing devices and none of the disadvantages. To attain this, the present invention provides for an elongated pushing member which is attachable to a saw miter gauge and which includes a U-shaped frame portion designed to move over and past a saw cutting blade without any interference or contact therewith. The pushing member operates to push against one or more pieces of styrofoam to be cut by the saw and to guide the same past the saw cutting blade. The U-shaped frame member includes a safety extension which operates to push the cut portion of the styrofoam off of the table saw without the necessity of an operator utilizing his hands to accomplish the styrofoam removing operation. The invention further includes a side guide member which is provided with a slot on a topmost portion thereof and which is attachable to the saw fence in an abutting relationship therewith through the use of a C-clamp positioned between the aforementioned slot and fence. An end of the side guide member terminates just past the cutting blade of the saw whereby the styrofoam is provided with space for expansion after having been cut, thus preventing any binding or kickback normally expected in the cutting of styrofoam. In a modified embodiment of the invention, the U-shaped frame member is adjustable in width whereby the desired amount of clearance between the saw blade and the pushing member can be easily selected by an operator.

It is therefore an object of the present invention to provide a saw workpiece pushing device that is particularly well adapted for the cutting of styrofoam or other similar expansible material and that has all of the advantages of the prior art saw workpiece pushing devices and none of the disadvantages.

Another object of the present invention is to provide a saw workpiece pushing device which is simple in construction and which utilizes a minimum of moving parts.

Still another object of the present invention is to provide a saw workpiece pushing device that is efficient and reliable in operation.

Yet another object of the present invention is to provide a saw workpiece pushing device which will remove cut styrofoam from a table saw without any necessity of an operator utilizing his hands to do the same.

A further object of the present invention is to provide a saw workpiece pushing device that may be easily and economically manufactured.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
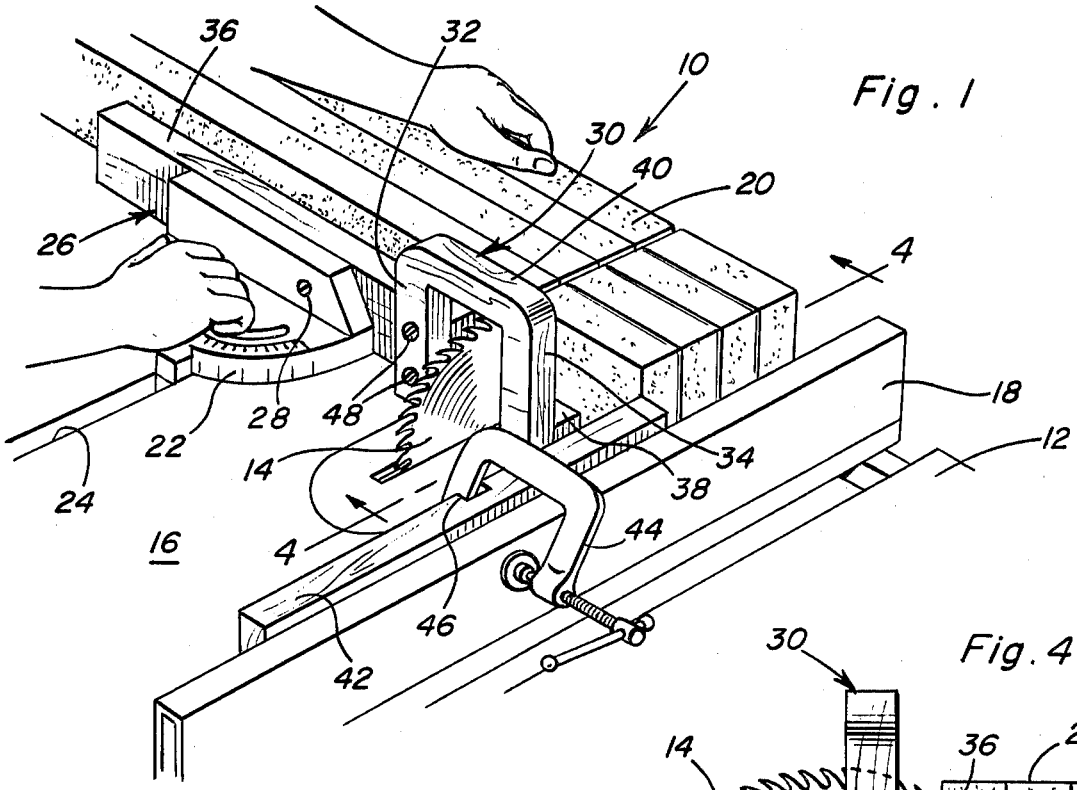
FIG. 1 is a perspective view of the saw workpiece pushing device forming the present invention operably installed on a table saw.

With reference now to the drawings, and in particular to FIG. 1 thereof, a saw workpiece pushing device embodying the principles and concepts of the present invention and generally designated by the reference numeral 10 will be described. In this respect, it can be seen that the saw workpiece pushing device 10 is operably mounted on a conventional table saw 12 which includes a powered rotary cutting blade 14 extending upwardly through a flat table portion 16 associated therewith. In this respect, the table saw 12 conventionally includes a guide fence 18 mounted on the table portion 16 of the saw 12, such guide fence being selectively movable to various positions on the table portion and serving to guide a workpiece, such as styrofoam 20, through and past the cutting blade 14. Also conventionally provided on the table saw 12 is a miter gauge 22 which is slidably positionable within a slot 24 contained on the table portion 16 of the saw, such miter gauge being normally used to both guide and push a workpiece 20 past the cutting blade 14 in a well-known manner.

As illustrated, it can be seen that the present invention includes a pushing member 26 which is fixedly securable to the miter gauge 22 through the use of conventional attachment means, such as a screw 28, and includes a U-shaped frame member portion 30 on one end thereof. In this regard, the U-shaped frame member portion 30 includes two downwardly extending legs 32, 34, one of such legs being attached to an elongated member 36 which is fixedly secured to the miter gauge 22 through the use of the aforementioned screw 28, and the other downwardly extending leg 34 having a safety extension 38 fixedly secured thereto. In this connection, the downwardly extending legs 32, 34 are integrally joined together by a topmost cross-extending member portion 40 which completes the shape and design of the U-shaped frame member portion 30.

Further illustrated in FIG. 1 is the positioning of the side guide member 42 along the aforementioned fence 18, such side guide member being operably attached to the fence through the use of a C-clamp 44. In this regard, the side guide member 42 is provided with a slot 46 on a topmost portion thereof, whereby the C-clamp 44 may be positioned therein so as to be brought into engagement with the guide member and the fence 18 in the manner illustrated. The slot 46 facilitates the attachment of the C-clamp 44 between the guide member 42 and the fence 18, while at the same time providing for clearance between the C-clamp and the workpiece 20 so as to prevent any substantial interference or contact therebetween during a cutting operation.

Figure 2:
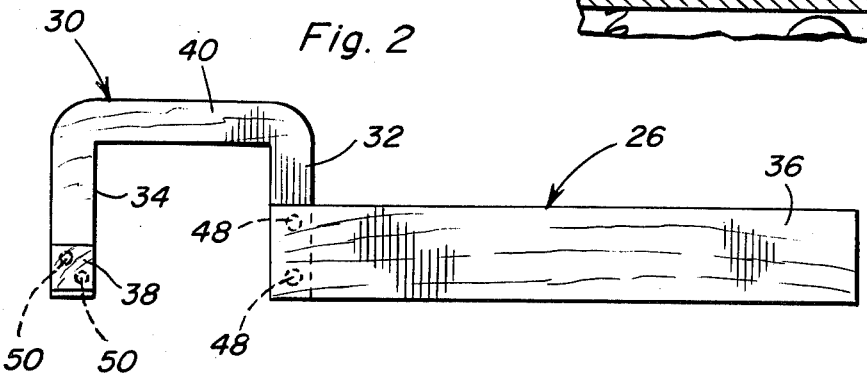
FIG. 2 is a longitudinal plan view of the pushing member forming a part of the present invention.

With reference to FIG. 2 of the drawings, the specific structural details of the pushing member 26 can be ascertained. In this respect, it can be seen that the elongated member portion 36 of the invention may be operably attached to the first downwardly extending leg 32 of the frame member portion 30 through the use of conventional attachment means, such as wood screws 48. Similarly, it can be seen that the safety extension 38 may be attached to the second downwardly extending leg 34 through the use of conventional attachment means, such as wood screws 50. By the same token, it will be noted that neither the safety extension member 38 nor the elongated member 36 extend into any portion of the space between the downwardly extending legs 32, 34, whereby the space is kept clear and open to facilitate a movement of the saw blade 14 therethrough during a cutting operation. In this regard, the legs 32, 34 are of a sufficient length to facilitate a free movement of the saw blade 14 pass the pushing member 26 without the blade coming into contact with the cross-extending member 40 integrally forming a part of the U-shaped frame member portion 30.

Figure 3:
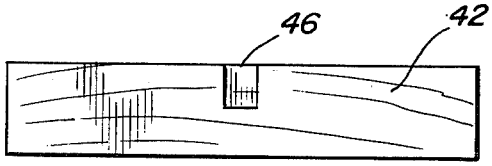
FIG. 3 is a longitudinal plan view of the side guide member forming a part of the present invention.

FIG. 3 has been provided to illustrate the positioning of the slot 46 within the side guide member 42. In this connection, it can be seen that the slot 46 need only to extend partially across both a transverse width and horizontal height of the guide member since its sole function is to provide an abutment recess for an end of the C-clamp 44. Specifically, the slot 46 should be of a sufficient depth to facilitate the retention of the C-clamp 44 therein while not permitting any portion of the C-clamp to interfere with a workpiece 20 being guided along the guide member 42.

Figure 4:
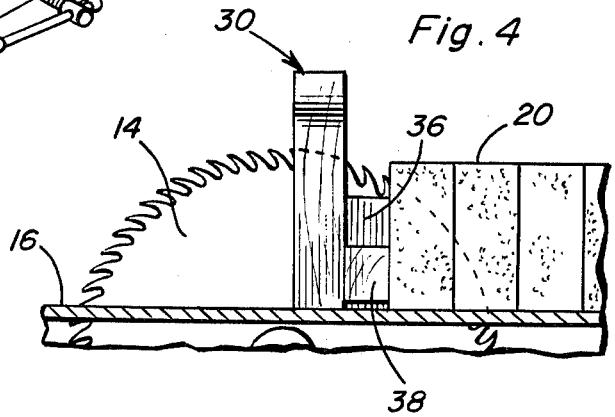
FIG. 4 is a transverse cross-sectional view taken along the line 4—4 of FIG. 1 which particularly illustrates the safety extension forming a part of the present invention.

FIG. 4 illustrates the pushing member 26 in its operable environment whereby a plurality of pieces of styrofoam 20 are being cut by the cutting blade 14. In this respect and referring to FIG. 1 concurrently with FIG. 4, it can be seen that the safety extension member 38 operates to push the cut styrofoam pieces past the cutting blade 14 and along the table portion 16 to some point where the cut pieces drop off of the table saw 12. As can be appreciated, this removing operation of the cut pieces of styrofoam 20 would normally be accomplished by an operator through the use of his hands; however, in the present invention, this removing function is performed by the safety extension member 38.

Figure 5:
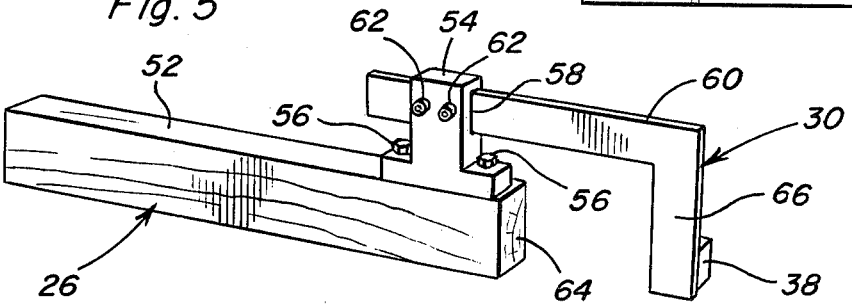
FIG. 5 is a perspective view illustrating a modified embodiment of the present invention whereby the U-shaped frame member portion of the invention is adjustable in width.

With reference to FIG. 5 of the drawings, a slightly modified embodiment of the present invention will be described. Whereas the embodiment of the present invention as illustrated in FIGS. 1–4 would normally be constructed of wood, the embodiment illustrated in FIG. 5 is envisioned as being constructed of a metallic material, such as aluminum, or the like, whereby additional versatility and strength can be achieved. In this regard, the pushing member 26 forming the basis of the embodiment of FIG. 5 would utilize an elongated metallic member 52 to which an upstanding inverted T-shaped member 54 might be attached through the use of conventional attachment means, such as bolts 56. Additionally, the T-shaped member 54 would be provided with a slot or aperture 58 through which an end portion of an L-shaped member 60 could be positioned. Once an end of the member 60 is positioned within the slot 58, the same may be selectively secured therein through the use of conventional attachment means, such as set screws 62. Effectively then, the L-shaped member 60 in combination with the T-shaped member 54 serves to define the U-shaped frame member portion 30 as illustrated in the embodiment of FIG. 1. In this regard, the safety extension member 38 may be provided on the remaining free end of the L-shaped member 60 so as to complete the construction of the embodiment of FIG. 5. Accordingly, this form of the present invention allows for an adjustment of the space between an end 64 of the elongated member 52 and the downwardly extending arm portion 66 of the L-shaped member 60, thus to accommodate various size cutting blades 14 and required working spaces. Of course, this embodiment of the present invention would be utilizable in combination with a side guide member 42 which would be of an identical construction to that illustrated in FIG. 3. Alternatively, the slot 46 could be eliminated along with the C-clamp 44, and the guide member 42 could then be bolted or otherwise affixed securely to the guide fence 18.

In operation, a user who wishes to cut one or more pieces of styrofoam 20 need only to attach the pushing member 26 to a conventional miter gauge 22 through the use of a screw 28 or similar attachment means. In this regard, the pushing member 26 should be attached to the miter gauge 22 in a manner whereby a movement of the miter gauge within the slot 24 will permit the U-shaped member portion 30 of the pushing member to move over and past the saw cutting blade 14 without any interference or contact therewith. At the same time, the side guide member 42 should be attached in a longitudinally extending abutting relationship with the conventional fence 18 through the use of the C-clamp 44 or similar attachment means whereby the downwardly extending leg 34 associated with the U-shaped frame member portion 30 will slidably abut against the side guide member. As can be appreciated, the attachment of the pushing member 26 and the side guide member 42 to the respective saw parts 22, 18 can be quickly and easily performed. With the table saw 12 then turned on, whereby the cutting blade 14 is being rotated by an external power source, an operator need only to position one or more pieces of styrofoam 20 against the pushing member 26 in the manner illustrated in FIG. 1, and then move the miter gauge 22 along the slot 24 to effect a movement of the styrofoam into cutting contact with the cutting blade 14. As is apparent, a continual movement of the pushing member 26 results in the styrofoam 20 being severed by the blade 14, and the safety extension member 38 operates to push the cut portions of the styrofoam off of the table without any necessity of an operator utilizing his hands to accomplish such a removing operation.

If it is desired to vary the width of the space between the downwardly extending arms 32, 34 forming a part of the frame member portion 30, an operator might revert to the embodiment of FIG. 5 whereby a similar construction of the present invention is illustrated, with the exception that the U-shaped member portion 30 is adjustable in width. This adjustability affords the user the opportunity to select the most efficient cutting space, thus to eliminate binding and kickback normally associated with the cutting of styrofoam.

With respect to the above description, it should be realized that the optimum dimensional relationships for the parts of the invention are deemed readily apparent and obvious to one skilled in the art to which the invention pertains, and all equivalent relationships to those illustrated in the drawings and described in the specification, to include modification of form, size, arrangement of parts and details of operation, are intended to be encompassed by the present invention.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A saw workpiece pushing apparatus for use in combination with a table saw, said apparatus comprising:

pushing means for guiding and pushing said workpiece into cutting contact with a cutting blade operably associated with said table saw;

guide means for facilitating a guiding of said workpiece past said cutting blade during said cutting contact;

extension means operably connected with said pushing means and serving to remove cut portions of said workpiece from a vicinity of said cutting blade thereby to eliminate a need for an operator to perform such a removing operation manually thus to substantially reduce a danger of injury to said operator, said pushing means including an inverted U-shaped member portion which is designed to slidably move along said guide means and which can move over and past said cutting blade without any interference and contact between said blade and pushing means, said extension means being fixedly secured to said inverted U-shaped member portion, said U-shaped member portion including first and second downwardly extending legs, said first downwardly extending leg being attached to an elongated extension member and said second downwardly extending leg being attached to said extension means, said guide means comprising an elongated member selectively attachable to a table saw guide fence in an abutting relationship therewith, said pushing means being selectively attachable to a miter gauge conventionally associated with a table saw, said guide means being provided with a slot on a topmost portion thereof, said slot facilitating an attachment of said guide means to said fence through an operable positioning of a C-clamp therein, said C-clamp being operable to hold said guide means and said fence together in said abutting relationship.

2. The saw workpiece pushing apparatus as defined in claim 1, wherein said guide means defines a space between said fence and a remote cutting edge of said cutting blade whereby styrofoam being cut by said cutting blade can expand into said space thus to eliminate binding and kickback normally associated with a cutting of styrofoam.

3. A saw workpiece pushing apparatus for use in combination with a table saw, said apparatus comprising:

pushing means for guiding and pushing said workpiece into cutting contact with a cutting blade operably associated with said table saw;

guide means for facilitating a guiding of said workpiece past said cutting blade during said cutting contact;

extension means operably associated with said pushing means and serving to remove cut portions of said workpiece from a vicinity of said cutting blade thereby to eliminate a need for an operator to perform such a removing operation manually thus to substantially reduce a danger of injury to said operator, said pushing means including an inverted U-shaped member portion which is designed to slidably move along said guide means and which can move over and past said cutting blade without any interference and contact between said blade and said pushing means, said extension means being fixedly secured to said inverted U-shaped member portion, said inverted U-shaped member portion including first and second downwardly extending legs, said first downwardly extending leg being attached to an elongated extension member and said second downwardly extending leg being attached to said extension means, said guide means comprising an elongated member selectively attachable to a table saw guide fence in an abutting relationship therewith, said guide means being provided with a slot on a topmost portion thereof, said slot facilitating an attachment of said guide means to said fence through an operable positioning of a C-clamp therein, said C-clamp being operable to hold said guide means and fence together in said abutting relationship.

4. The saw workpiece pushing apparatus as defined in claim 3, wherein said U-shaped member portion is adjustable in width.

* * * * *